US006050726A

United States Patent [19]

Hoerl

[11] Patent Number: 6,050,726

[45] Date of Patent: Apr. 18, 2000

[54] GLOVE BAG

[76] Inventor: Bryan J. Hoerl, 1807 20th Ave., NE, Rochester, Minn. 55906

[21] Appl. No.: 09/020,160

[22] Filed: Feb. 7, 1998

[51] Int. Cl.[7] ..... B65D 30/00

[52] U.S. Cl. ..... 383/127; 383/24; 383/63; 383/75; 294/1.3

[58] Field of Search ..... 383/4, 63, 75, 383/127, 907, 24; 294/1.3

[56] References Cited

U.S. PATENT DOCUMENTS

| | | | |
|---|---|---|---|
| 3,850,467 | 11/1974 | Johnson | 294/1.3 |
| 4,788,733 | 12/1988 | Lerner | 294/1.3 X |
| 4,845,781 | 7/1989 | Strickland et al. | 383/4 X |
| 4,937,881 | 7/1990 | Heise | 383/907 X |
| 5,121,776 | 6/1992 | Kovach | 383/11 X |
| 5,222,777 | 6/1993 | Clonch | 294/1.3 |
| 5,439,708 | 8/1995 | Jacovitz | 2/161.6 |
| 5,671,983 | 9/1997 | Miller et al. | 383/63 X |
| 5,704,670 | 1/1998 | Surplus | 383/4 X |
| 5,725,268 | 3/1998 | Besasie et al. | 294/1.3 |

*Primary Examiner*—Jes F. Pascua
*Attorney, Agent, or Firm*—D. L. Tschida

[57] ABSTRACT

A plastic bag constructed to include an integral glove or mitten. The glove extends from a bag surface that facilitates the fitting of the glove to the hand, yet permits objects to be gripped and deposited or withdrawn from a container portion of the bag. A closure fastener seals the bag to contain the collected materials and the soiled surface of the glove inside the bag. In various constructions, the glove extends from the bottom of the bag or a tapered surface that lies above the bottom. A hand can be fitted into the glove from the exterior or interior and is positioned to facilitate collection and access to an open mouth. Bags including a drawstring closure, interlocking seals and one or more rigid scraper edges are disclosed.

15 Claims, 7 Drawing Sheets

GLOVE BAG

BACKGROUND OF THE INVENTION

The present invention relates to collection containers and, in particular, to a bag including a glove portion that can be fitted to the hand and that is located adjacent an opening to a container portion to permit gripping, depositing and sealing items in the bag.

A variety of sanitary collection devices have been developed to facilitate the collection of different materials and items while avoiding physical contact. Plastic and elastomer gloves are commonly used in the food service, health and hair care industries, to name a few, to protect the hands and handled materials from mutual contamination. The gloves are constructed to be low cost and disposable and are frequently packaged individually or in rolls for easy access. Various finger arrangements can be provided at the gloves. The gloves permit full use of the hands to perform desired tasks and provide a full range of gripping. After each procedure, the gloves are discarded.

Numerous collection devices have also been developed for collecting animal feces that variously support a disposable container to permit an individual to collect and dispose of animal feces in a sanitary manner. Some of the assemblies include handles or a hand operated linkages that support a collection container, for example, a plastic or paper bag or box. U.S. Pat. Nos. 3,977,715; 4,047,746; 4,103,952; 4,136,900; 4,138,153; 4,154,389; 4,205,869; 4,335,678; 4,718,707; 4,875,729; 5,403,050; 5,511,682; 5,540,469; 5,586,521; and 5,620,220 disclose various devices which use a collection bag.

Some collection devices include specially formed bags or are organized in kits and include hardened scoops. For example, U.S. Pat. Nos. 3,978,540; 4,186,955; 4,230,354; and 4,252,356 disclose bags with rigid portions that aid in the scooping or scraping of waste into the bag.

Disposal assemblies for animal feces also exist that utilize a glove. U.S. Pat. No. 4,645,251 provides an internal padded glove that cooperates with a disposable glove. U.S. Pat. Nos. 4,788,733 and 4,836,594 disclose other glove bag combinations wherein a discrete glove is secured to a detachable container or the glove can be inverted and used as the container.

Although all of the foregoing devices collect and facilitate disposal of animal feces, applicant believes a glove arrangement provides the greatest flexibility and dexterity in collecting animal feces. A gloved assembly is also readily adapted to varieties of industries and applications where items are being collected and packaged and contamination is an issue. The present invention was therefore developed to provide a bag having a wall of a storage space or container portion fitted with a multi-finger glove or mitten that can access the storage space. The glove is positioned adjacent an opening to the storage space and can be manipulated, inverted or withdrawn into the storage space to deposit feces or collected materials into the storage space. The edges of the glove and open end of the bag may also be constructed with hardened edges to facilitate collection and sealing of collected materials in the bag.

SUMMARY OF THE INVENTION

Accordingly, it is a primary object of the invention to provide a bag or storage container that includes a glove at a wall and which glove can be manipulated, extended or inverted through an open mouth of the bag to permit collection and storage of collected materials in the bag.

It is a further object of the invention to provide an open mouth that includes a drawstring or interlocking seals.

It is a further object of the invention to provide an open mouth that includes rigid portions that can serve as scrapers or jaws to facilitate collection.

It is a further object of the invention to provide a glove bag that is constructed of a die cut, sheet stock material that is folded and heat sealed, and that can include rigid or semi-rigid interlocking seals or a drawstring.

It is a further object of the invention to provide a glove bag having rigid edge flaps at the glove that can be used as scrapers.

Various of the foregoing objects, advantages and distinctions of the invention are obtained in a presently preferred combination bag and glove. The bag generally includes a glove or mitten portion that is shaped to receive a hand and that extends from a wall of the bag and is accessible to a storage space of the bag. Alternative bags are disclosed wherein different gloves are variously positioned about the walls of different bags. In one construction and during collection, the hand extends through an open mouth of the bag into the glove. The glove and bag are inverted and withdrawn into the bag upon collecting a desired material. In another construction, the hand is extended into the fingers of the glove to invert the glove through the storage space and open mouth of the bag. The collected materials and glove are withdrawn into the bag and the bag sealed for storage. In another construction, the glove extends from a sealed opening at a side wall of the bag through the open mouth. An adjoining storage space depends below the glove to contain collected materials that are selected and deposited in the bag.

A drawstring or interlocking seals bonded to the open mouth of the bag, contain collected materials for storage and disposal. Rigid or semi-rigid edges can be provided at the open mouth of the bag or along the periphery of the glove to facilitate collection.

Still other objects, advantages and distinctions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

DESCRIPTION OF THE PREFERRED EMBODIMENTS

Figure 1:
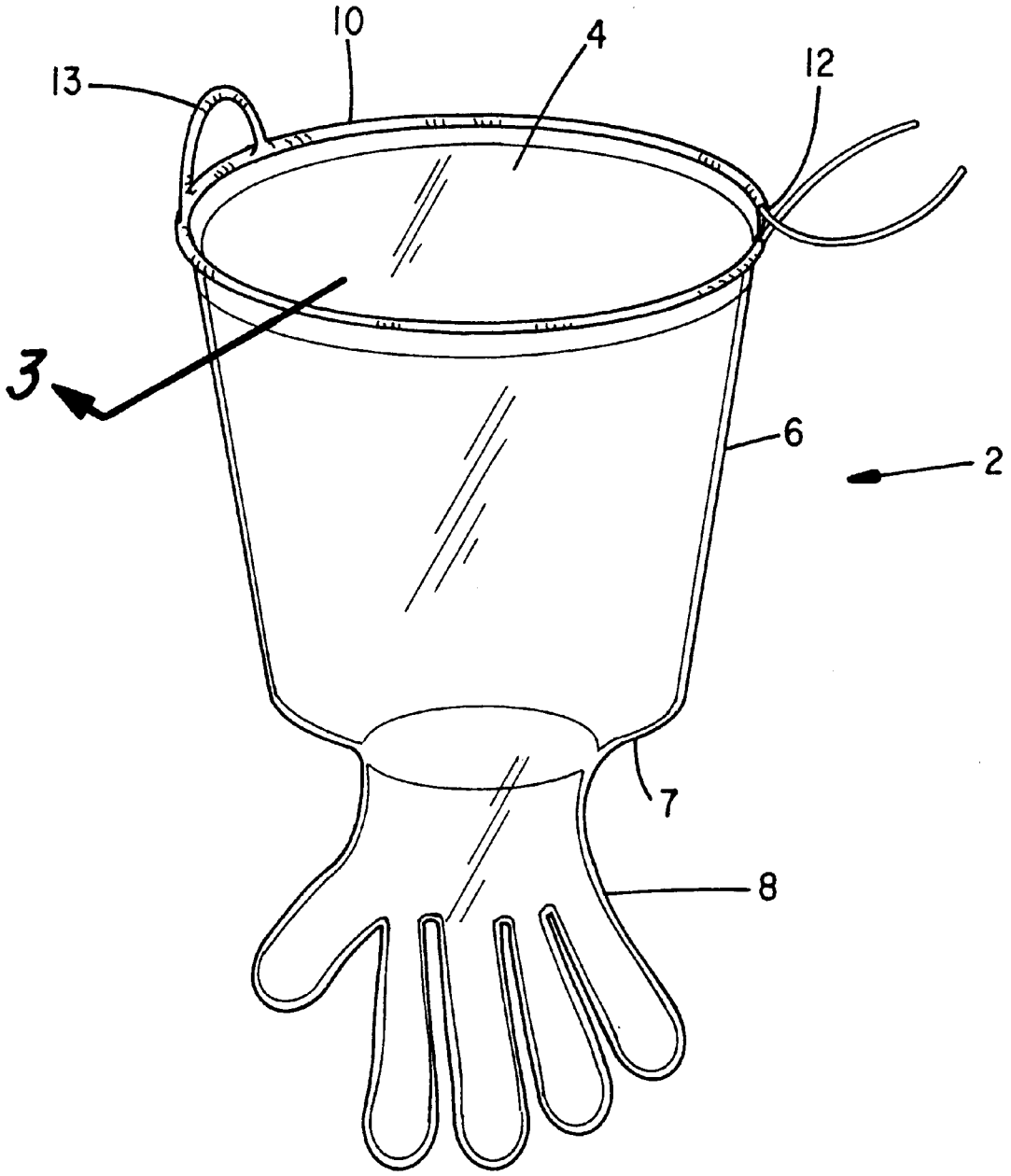
FIG. 1 is a perspective drawing showing an edge sealed glove bag.

Referring to FIG. 1, an improved plastic collection and storage bag 2 of the invention is shown in perspective view.

Figure 3:
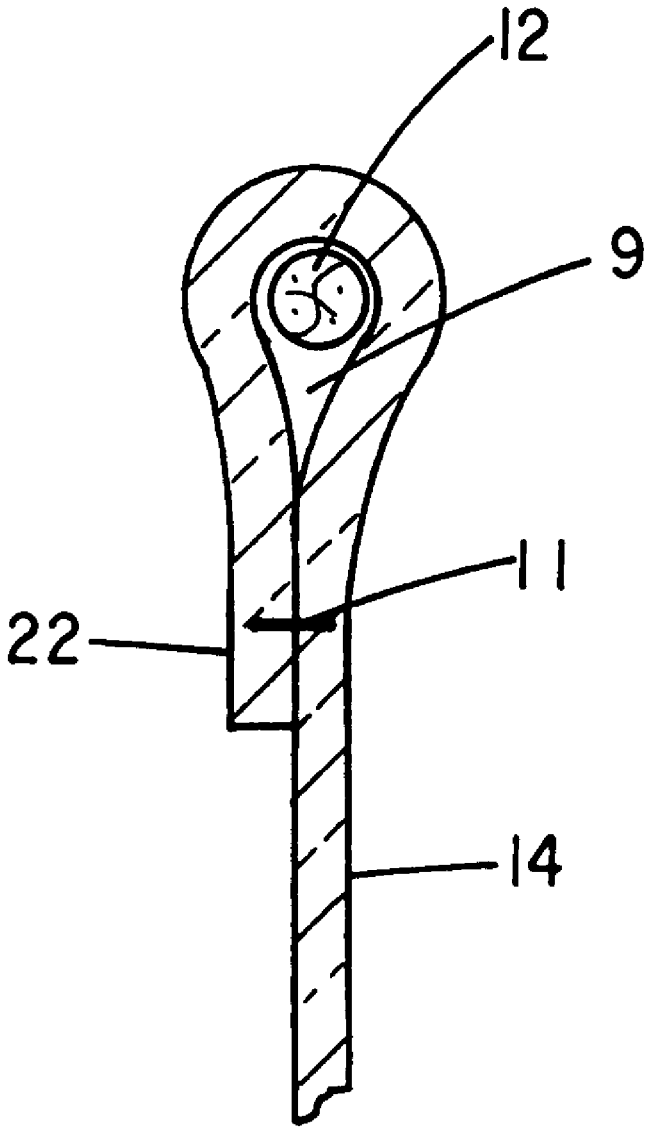
FIG. 3 is a section view taken along section line 3—3 of FIG. 2 to the fold at the drawstring.

The bag 2 includes a container portion 6 and a glove portion 8. The container 6 defines a storage space 4. The glove 8 extends from a bottom wall 7 of the container portion 6, although can extend from any surface of the container 6. The glove 8 opens to the storage space 4 in the region of the wrist. An open end or mouth 10 of the container 6 includes a drawstring 12. The drawstring 12 is fitted through a channel 9 that is formed by overlapping portions of the peripheral edge of the mouth 10 and sealing the overlapped material together at a heat sealed seam 11, reference FIG. 3. A handle 13 extends from the open mouth 10.

In normal use, a user's hand can be fitted through the open mouth 10 and storage space 4 and into the glove 8. In this instance, the container 6 forms a type of cuff. With the collection of desired materials in the gloved hand, the container 6 is inverted or rolled over the glove 8 to contain the glove 8 and collected materials in the inverted storage space 4. The hand is withdrawn from the glove 8 and the drawstring 12 is pulled taught and or wrapped about the collected ends of the open mouth 10 to seal the container 6 and the collected contents for disposal.

Alternatively, a hand can be inserted into the fingers of the glove 8 from the exterior and the glove 8 extended through the open mouth 10 to permit gripping and collection of desired materials. Upon withdrawing the glove 8 and gripped materials into the container 6, the open mouth 10 is sealed.

In either of the foregoing alternative uses of the bag 2, the glove 8 isolates the hand of the user from the collected materials. Neither the hand nor the collected materials are contaminated by the other and a sanitary collection is obtained.

It is to be appreciated the bag 2 can be used to advantage for collecting a variety of items and materials without extraneous motions and without contacting the materials with the hand. The construction of the bag 2 permits full use of the hand to facilitate collection and placement of the materials into the container 6.

Although one construction of bag 2 and glove placement are shown at FIG. 1, the glove 8 can extend from any desired surface of the container 6. The container 6 can be constructed to a variety of shapes to facilitate manipulation of the hand through the storage space 4 and storage of the collected materials. The container 6 can also be constructed to a variety of sizes to accommodate the materials being collected. The surfaces of the bag 2 may also be fitted with other devices to facilitate collection, such as handles or rigid edges that can serve as scrapers.

Similarly, the glove 6 can be constructed to a variety of sizes and shapes. The glove 6 may also be configured as a mitten shape, with or without finger sections. A variety of attached or detached fasteners, such as twist ties, interlocking seams (e.g. zip-lock or zipper fasteners) or draw closures fasteners can also be incorporated into or secured to the bag 2 to facilitate the containment of collected materials. Some examples of alternative bags including the foregoing combinations of features are described below.

Figure 2:
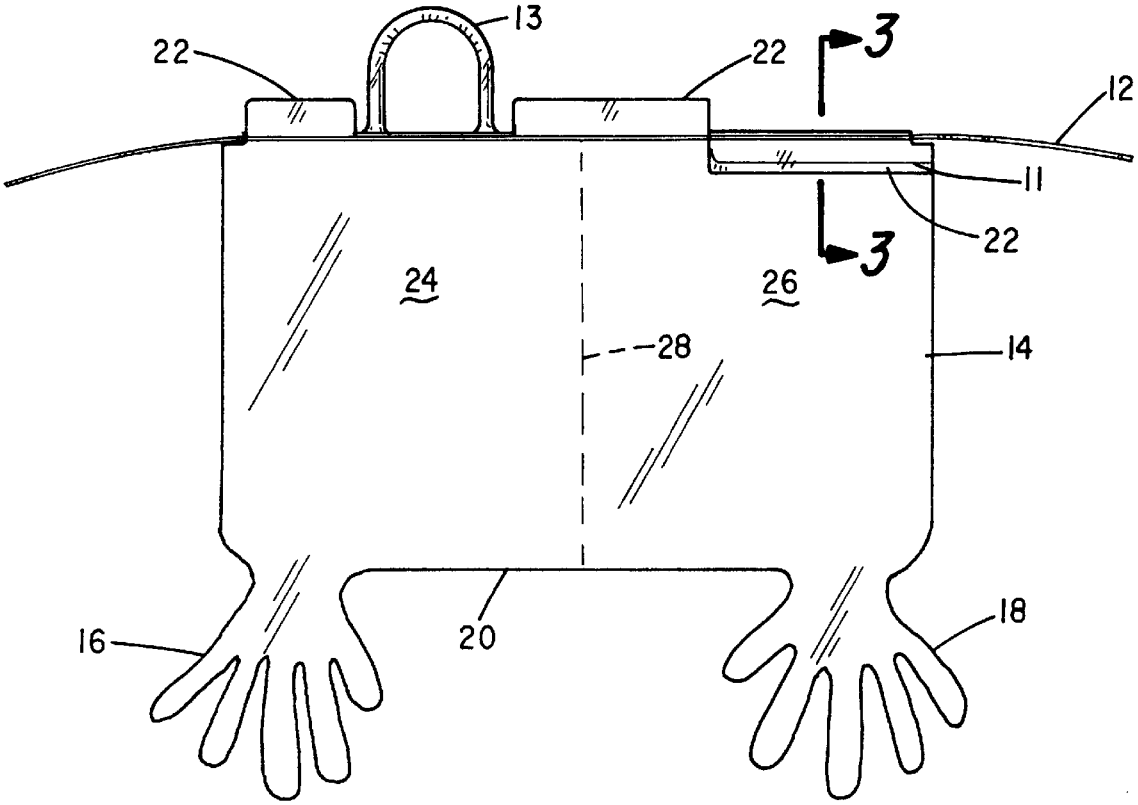
FIG. 2 is a plan view showing a bag laid flat with a portion aligned to a drawstring as it appears before and after being sealed in a channel defined at an open mouth of the bag.

With attention to FIG. 2, the bag 2 is shown as it appears when initially die cut from a piece of sheet stock material 14. The bag 2 can be formed from a variety of conventional materials having an appropriate thickness and compatibility to the application. A plastic material (e.g. polyethylene) is particularly preferred, due to its low cost and ease of working. Other types of sheet goods may however be used depending upon the materials being collected and the construction process.

The material 14 is cut to accommodate a folding operation and a pair of glove sections 16 and 18 are formed along a bottom edge 20. The material is cut oversized to accommodate selvage. A peripheral edge 22 at the open mouth 10 is folded over a drawstring 12 that is aligned to the material 14 and sealed. The edge 22 is depicted with portions folded and unfolded. The edge 22 can be continuous or formed in sections, such as when an intervening handle 13, is provided.

The halves 24 or 26, as defined relative to a fold line 28 (shown in dashed line), are next folded into alignment with each other and with the glove sections 16 and 18 aligned to each other. The overlapping edges are sealed and any selvage is trimmed from the border. Sealing can be effected with heat, an adhesive or sonic bonding, among other techniques.

Although a folded fabrication technique is disclosed, other techniques can be used to construct the bag 2. For example, the halves 24 and 26 can be separately cut, and appropriate attachments (e.g. handles, seals etc.) can be bonded to the halves, prior to overlapping and bonding the halves together. The glove 8 can also be separately constructed and bonded to an opening of a length of tubular material that defines the container portion 6. Still other construction techniques will be apparent to those skilled in the art.

Figure 4:
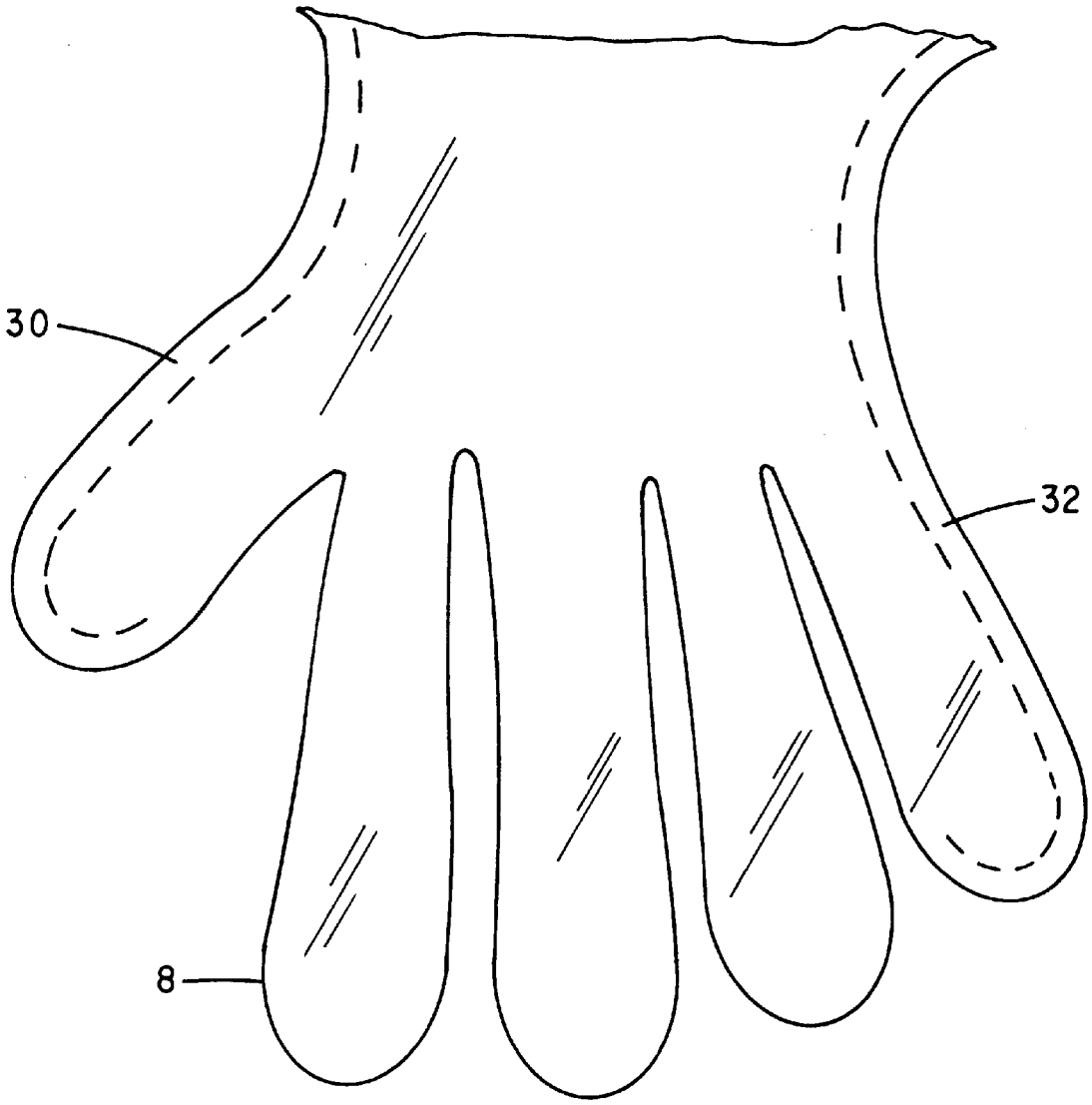
FIG. 4 is a detailed view to an alternative glove that has rigid scrapers fixed to the periphery of the glove.

Separately depicted at FIG. 4 is a glove 8 that includes scrapers 30 and 32 along the peripheral edges of the glove 8. The scrapers 30 and 32 can be formed from overlapped portions of the material 14, that are sealed to each other and that might otherwise be trimmed as selvage. The scrapers 30 and 32 can also consist of separately bonded, rigid members. The mounting location and shape of the scrapers 30 and 32 can be determined as desired.

If one or both of the scrapers 30, 32 is constructed as a separately formed, rigid member, the scraper 30 and or 32 might have a thickness of 0.020 to 0.100 inches. The edges of the scrapers 30 and 32 may also include beveled and or serrated regions, among other possible shapes, to facilitate the collection process. The scrapers 30 and 32 may also extend only partially along the edges of the glove 8. They might also be provided at the container 6.

Figure 5:
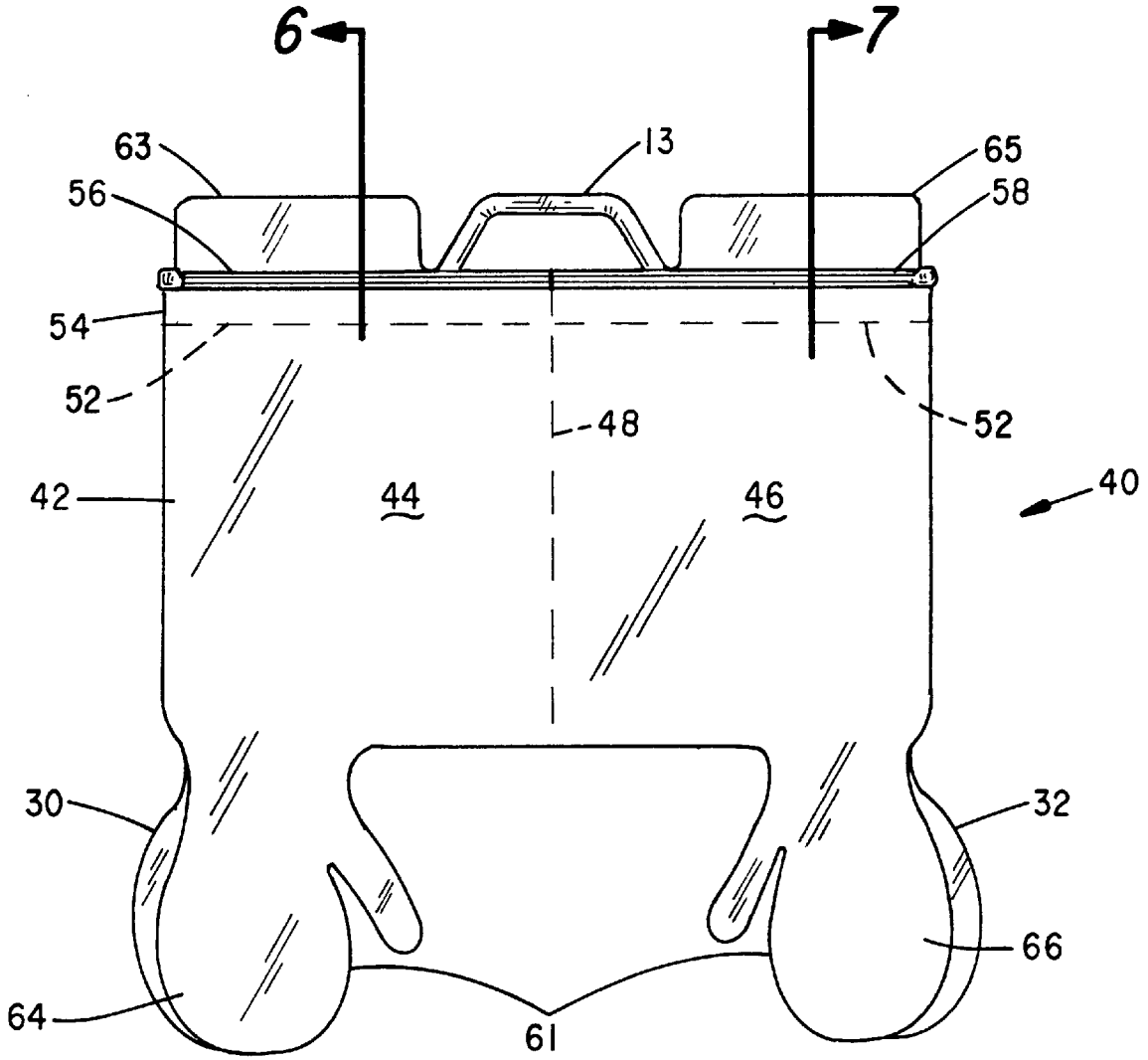
FIG. 5 is a plan view showing a bag laid flat which includes a separately sealed handle, rigid scrapers and interlocking seals.

FIG. 5 shows another bag 40 of the invention. The bag 40 is constructed of a die cut, sheet stock material 42. Halves 44 and 46 are joined at a fold line 48 (shown in dashed line). Bonded to a peripheral edge 50 of the material 42 at a heat sealed seam 52 is a band of closure material 54. The material 54, for example, a ZIPLOCK material, contains mating closure portions 56 and 58.

Figure 6:
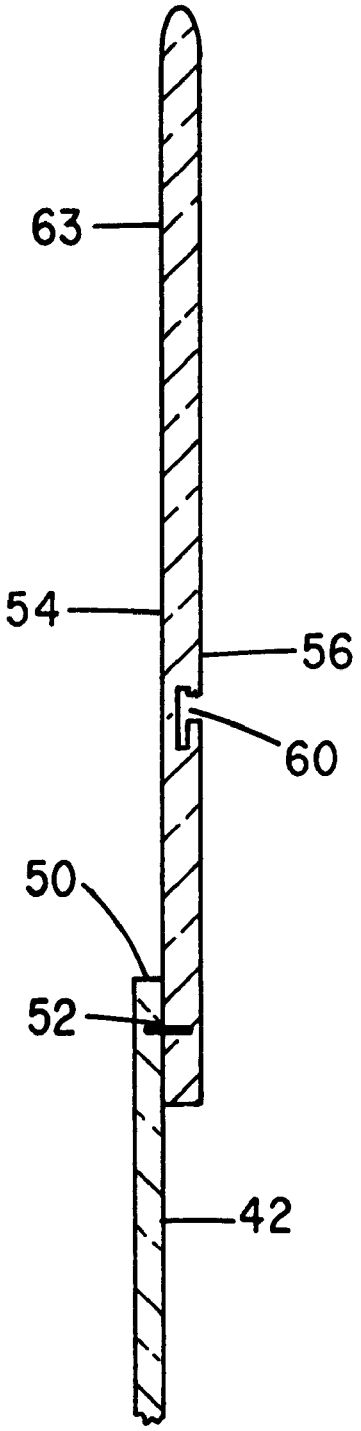
FIG. 6 is a section view taken along section line 6 of FIG. 5 through one of the welded seals.
Figure 7:
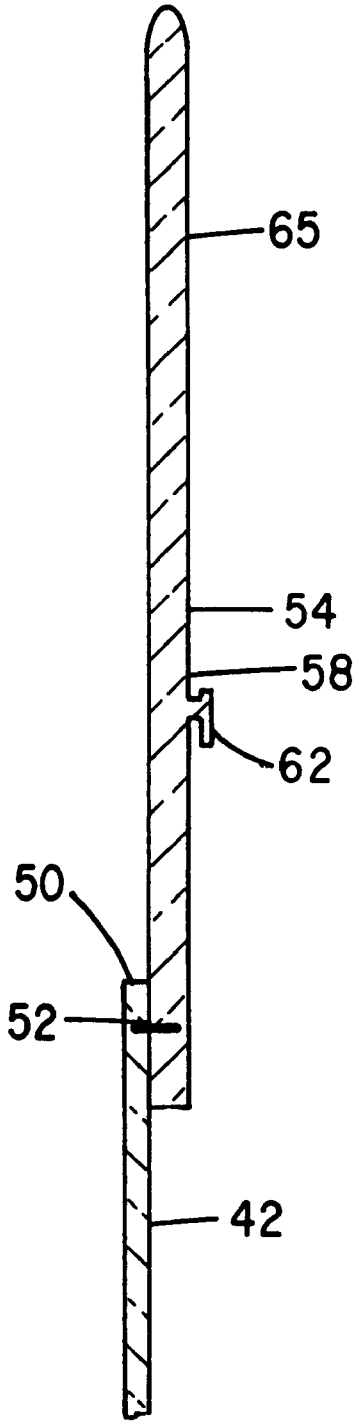
FIG. 7 is a section view taken along section line 7 of FIG. 5 through one of the welded seals.

FIGS. 6 and 7 depict cross section views to the mating portions 56 and 58. The portion 56 provides a resilient channel 60 and the portion 58 provides a beaded protrusion 62 that interlocks with the channel 60. That is, upon forcing the bead 62 against the channel 60, the channel 60 flexes to receive and contain the protrusion 62. Other interlocking fasteners can be used to similar advantage. For example, a plastic zipper fastener might be attached to the sections 44 and 46.

Separately secured to the portions 56 and 58 of closure material 54 are relatively thick, rigid scrapers 63 and 65. Mounted between the scrapers 63 and 65 is a separately attached handle 13. The closure material 54, scrapers 63 and 65, and handle 13 are appropriately bonded to one another, such as with heat, ultra sonic bonding or adhesives, prior to folding and sealing the halves 44 and 46.

In lieu of a glove 8, the bag 40 is formed to provide a mitten 61 that is defined upon overlapping and sealing the mitten sections 64 and 66 to one another. Separate scrapers 30 and 32 are formed or bonded to the completed mitten 61. Although a number of scrapers 63, 65 and 30, 32 are shown, it is to be appreciated, they can be fitted to the bag 40 as desired.

The bag 40 is useable in either of the previously described fashions, if the hand is intended to mount in the mitten 61 from the exterior, the scrapers 63 and 65 can be manipulated in the manner of cooperating jaws. Alternatively, the edge of one or the other scraper 63 or 65 can be used as a scoop. If the bag is constructed for the hand to mount through the bag 40, the scrapers 30 and 32 can be used.

Figure 8:
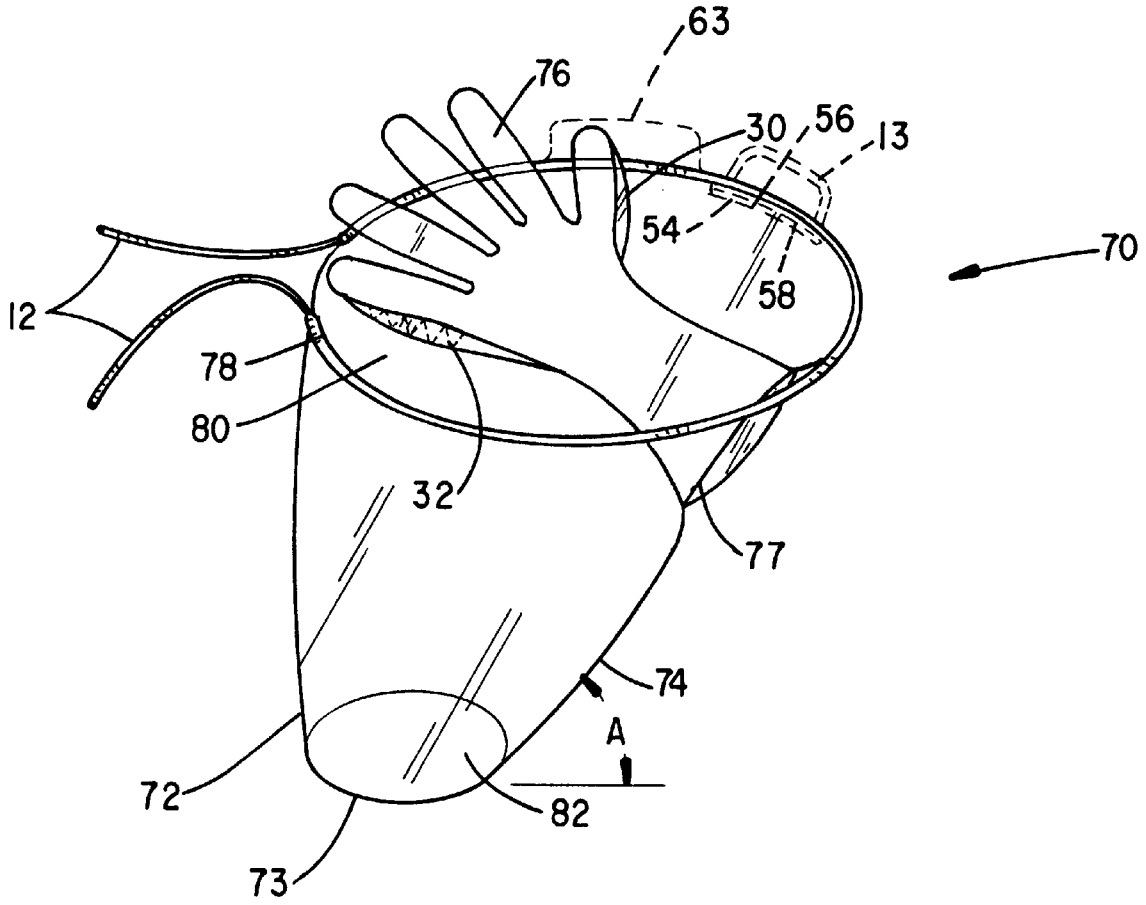
FIG. 8 is a perspective drawing showing a glove bag that has a glove sealed to a side wall and that extends through the open mouth adjacent a storage space.

Referring to FIG. 8, another bag 70 is shown in perspective. The bag 70 includes a container portion 72 that tapers along a side wall surface 74 to a bottom 73. A glove portion 76 extends from the tapered surface 74 and through an open mouth 78. A drawstring 12 is fitted to the open mouth 78. Scrapers 30 and 32 are also fitted to the glove 76.

The bag 70 can be constructed in the fashion of the bags 2 or 40. Alternatively, the glove 76 can be separately formed and sealed at a seam 77 at an opening provided along the surface 74. The dimensions of the bag 70 can be tailored as desired. However, it is preferred that the mouth 78 permit free use of the glove 76 and easy access to the mouth 78 to deposit collected materials into the bag 70. The surface 74 nominally tapers at an angle "A" in a range of 25 to 60 degrees from the bottom 73. The glove 76 is secured slightly below the mouth 78 and is positioned to provide a relatively large access area at the mouth 78. It is to be appreciated, the bag walls may constructed to other shapes. The bag 70 can also include serrations at the scrapers 30 and 32 (shown in dashed line), a loop handle 13 (shown in dashed line), a scraper 60 (shown in dashed line) and/or closure material 54 in lieu of the drawstring 12 (shown in dashed line).

In normal use, a hand is fitted into the glove 76 from the exterior of the bag 70. Materials are collected and deposited into the storage space 80. The materials particularly collect at a portion 82 of the storage space 80 that lies beneath the glove 76. The bag 70 therefore permits multiple collections of materials before the glove 76 is sealed in the bag 70 with the collected materials.

While the invention has been described with respect to a preferred and considered alternative constructions, still other constructions may be suggested to those skilled in the art. For example, scrapers, handles and closure fasteners can be variously fitted anywhere about the surfaces of the bag or combined in various combinations. The glove can extend from still other surfaces and the bag geometry can be varied to complement the glove. Multiple gloves and or mittens may also be fitted to the bag. It is also to be appreciated the various features described above can be combined in a variety of arrangements. The foregoing description and following claims should therefore be broadly construed to include all those embodiments within the spirit and scope of the following claims.

What is claimed is:

1. A storage bag comprising:

a) a container having walls that define an open end and a storage space;

b) glove means extending from said walls and communicating with said storage space for receiving a user's hand, wherein said glove means extends from a tapered surface of said container and through said open end; and c) drawstring means mounted to said open end for sealing said glove within said storage space, whereby materials can be hand collected with said glove and sealed within said storage space without the user contacting the collected materials.

2. A storage bag as set forth in claim 1 and wherein a rigid scraper extends from said glove means.

3. A storage bag as set forth in claim 2 wherein said glove means comprises a plurality of compartments that receive individual fingers.

4. A storage bag as set forth in claim 2 wherein said scraper includes a serrated surface.

5. A storage bag as set forth in claim 2 wherein said scraper is defined by overlapping portions or a plastic sheet material that are bonded together to define said glove means and that project from a peripheral edge of said glove means.

6. A storage bag as set forth in claim 1 wherein a plurality of scrapers extend from said glove means.

7. A storage bag as set forth in claim 1 wherein said open end includes a drawstring.

8. A storage bag as set forth in claim 1 wherein said open end includes interlocking seals and a looped handle.

9. A storage bag as set forth in claim 1 wherein said glove means defines a first compartment that receives a user's thumb and a second compartment that receives the remainder of the user's fingers.

10. A storage bag comprising:

a) a container having walls that extend from a closed bottom end to an open end and define a storage space therebetween and wherein a portion of said walls tapers as it extends from the bottom end;

b) glove means extending from the tapered portion of said walls and through said open end and communicating with said storage space and having a plurality of compartments that receive the fingers of a user's hand, and wherein a scraper extends from a peripheral edge of said glove means and c) means mounted to said open end for sealing materials collected with said glove means and said glove means within said storage space without the user contacting the collected materials.

11. A storage bag as set forth in claim 10 wherein said open end includes interlocking seals and a loop handle.

12. A storage bag as set forth in claim 10 wherein said scraper includes a serrated edge.

13. A storage bag as set forth in claim 10 wherein said open end includes a scraper.

14. A storage bag comprising:

a) a container having walls that define an open end and a storage space and wherein a scraper extends from said open end;

b) glove means extending from said walls and communicating with said storage space and having a plurality of compartments that receive the fingers of a user's hand and wherein a scraper extends from a peripheral edge of said glove means; and c) means mounted to said open end for sealing materials collected with said glove and said glove within said storage space.

15. A storage bag as set forth in claim 14 wherein said glove means comprises overlapped panels of a plastic material that are sealed together to define a hand space and wherein portions of the overlapped panels extending along a peripheral edge of said glove means are bonded to define a scraper.

* * * * *